United States Patent [19]

Braselton

[11] Patent Number: 4,829,719

[45] Date of Patent: May 16, 1989

[54] VIBRATING POLE FOR MOVING A PAD ON A WORKING SURFACE

[76] Inventor: Keith Braselton, 2176 Allston Pl., Fairfield, Calif. 94533

[21] Appl. No.: 158,464

[22] Filed: Feb. 22, 1988

[51] Int. Cl.[4] ..... B24B 23/04

[52] U.S. Cl. ..... 51/180; 51/170 TL; 51/170 MT; 15/144 A; 15/98

[58] Field of Search ..... 51/170 R, 170 TL, 180, 51/170 MT; 15/22 A, 22 C, 28, 98, 143 B, 143 A, 144 R, 144 A, 144 B

[56] References Cited

U.S. PATENT DOCUMENTS

| | | | |
|---|---|---|---|
| 2,238,757 | 4/1939 | Stevason . | |
| 2,526,976 | 10/1950 | Smith | 51/170 TL |
| 2,753,669 | 3/1955 | Larson . | |
| 4,062,152 | 12/1977 | Mehrer . | |
| 4,204,292 | 5/1980 | Lester | 51/180 |
| 4,263,755 | 4/1981 | Globus . | |
| 4,546,574 | 10/1985 | Blossick . | |
| 4,617,767 | 10/1986 | Ali . | |
| 4,685,252 | 8/1987 | Ponce . | |

*Primary Examiner*—Roscoe V. Parker

*Attorney, Agent, or Firm*—Townsend and Townsend

[57] ABSTRACT

A vibrating motor attached to a pole which has a plate for securing a working pad at the far end for application to a subject surface. The working pad may be sandpaper, a buffing pad, etc. The extension pole removes the vibrating sander from the vicinity of the working surface, thus eliminating the possibility of shorts or other damage to the vibrating motor where the surface is wet, dusty, etc. In the preferred embodiment, the vibration motor can rotate to be at different angles to the extension pole to allow different angles of application. The plate attached to the far end of the extension pole is similarly rotatable to fit the working surface. Both the sanding motor and the working pads may be attached to plates on the ends of the pole by virtue of a hook and loop type fastener (i.e., VELCRO).

6 Claims, 1 Drawing Sheet

VIBRATING POLE FOR MOVING A PAD ON A WORKING SURFACE

BACKGROUND

The present invention relates to devices for applying a working material, such as sandpaper, a polishing pad, etc., to a working surface through vibration.

Hand-held sanders typically have a flat bottom plate covered with felt across which a piece of sandpaper is stretched and secured at the ends. The user then manually pushes the sander across a surface to be sanded. Motorized sanders also exist, which use a similar plate but have a motor attached to the back of the plate for causing the vibration. The user then holds the motor and presses the sandpaper against the surface to be worked.

When dry walls are put up, the sheets of the dry wall are pasted together and the seams are sanded. For hard to reach seams, a device which has a plate for holding the sandpaper on the end of a pole is used, with the user pushing the rear end of the pole to move the sandpaper across the surface.

SUMMARY OF THE INVENTION

The present invention is a vibrating motor attached to a pole which has a plate for securing a working pad at the far end for application to a subject surface. The working pad may be sandpaper, a buffing pad, etc. The extension pole removes the vibrating sander from the vicinity of the working surface, thus eliminating the possibility of shorts or other damage to the vibrating motor where the surface is wet, dusty, etc.

In the preferred embodiment, the vibration motor can pivot to be at different angles to the extension pole to allow different angles of application. The plate attached to the far end of the extension pole is similarly rotatable to fit the working surface. Both the sanding motor and the working pads may be attached to plates on the ends of the pole by virtue of a hook and loop type fastener (i.e., VELCRO).

Preferably, a second pole extends from the mid-portion of the extension pole to provide an additional grip for a user. This second pole is mounted by a spring mechanism which isolates the user from the vibration of the pole. The vibration sander is itself designed to isolate the handle from the vibrations of the working end of the sander.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
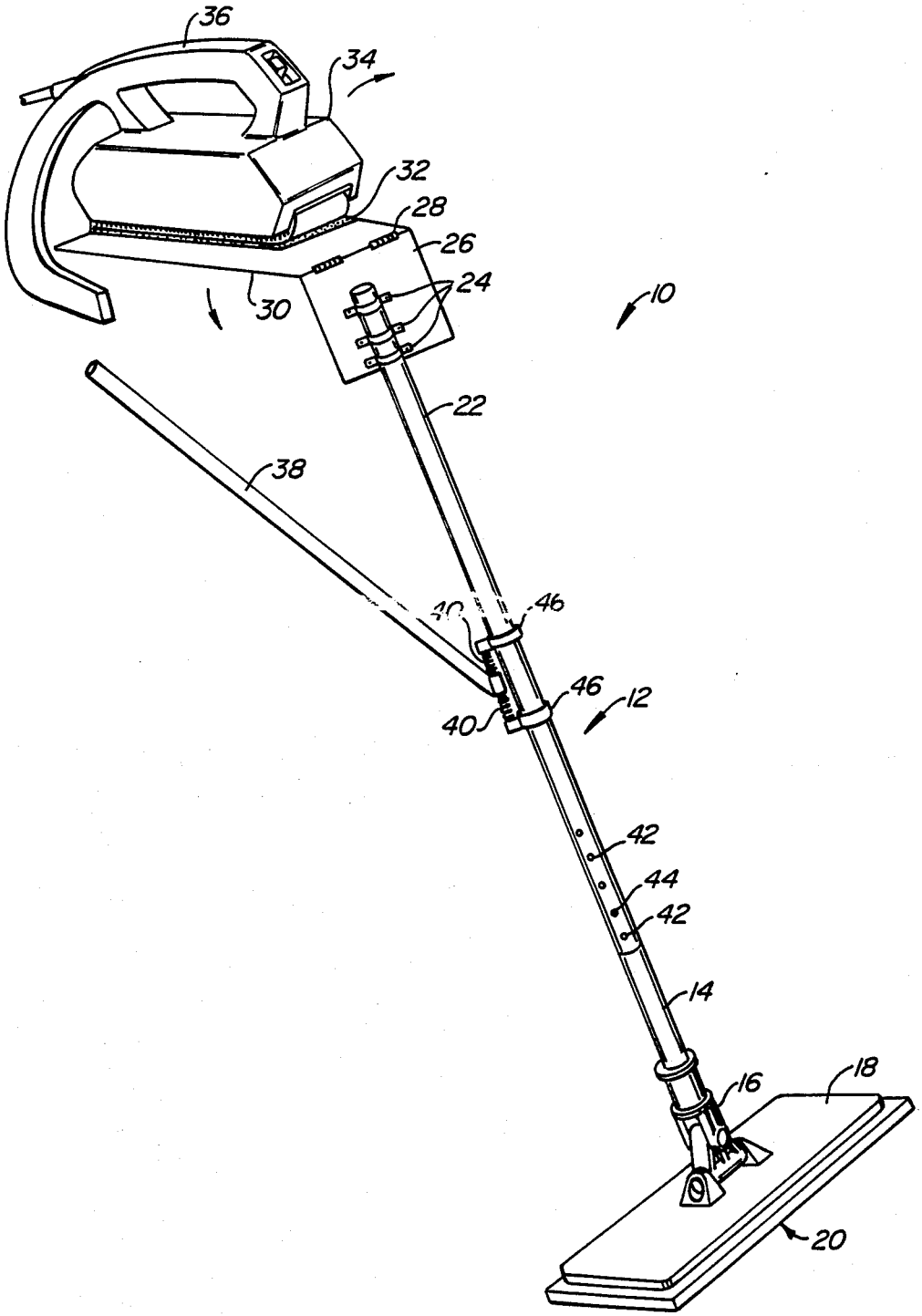
FIG. 1 is a perspective view of a vibrating extension pole according to the present invention.

FIG. 1 shows a vibrating extension pole mechanism 10 according to the present invention. The pole 12 has a first section 14 coupled to a universal joint 16 on a plate 18. An underside 20 of the plate has a hook and loop type fastener for attaching to a pad to be applied to a working surface.

A second section 22 of pole 12 is coupled by clamps 24 to a plate 26. Plate 26 is coupled by locking hinges 28 to a second plate 30 which has a hook and loop fastener strip 32 for coupling to a vibration sander 34.

Vibration sander 34 has a handle 36 which bends around to below plate 30 to allow a user to grip the handle at a comfortable position no matter what angle plate 30 is to plate 20.

A second pole handle 38 is coupled to a mid-section of pole 12 via a spring mechanism 40. Spring mechanism 40 isolates the vibrations of pole 12 from handle 38. Clamps 46 couple handle 38 to pole 12 and allow movement of handle 38 up and down along pole 12 so that a user can adjust it for optimum ease of use.

Pole 12 can be extended as shown by holes 42 which couple to a knob 44 in section 14 to allow extension of the pole. Alternately, other methods of extension could be used.

Because of the dual pivoting of the plate 30 and plate 18, extension pole 10 can be used in almost any position for almost any surface. It will be appreciated that the closer plate 30 is to being in line with plate 26, the more the vibration will be directed into the pole and thus against the working surface instead of across the working surface. This is advantageous in certain positions, such as where a user is holding the pole nearly vertical for application against a wall.

As will be understood by the those familiar with the art, the present invention may be embodied in other specific forms without departing from the spirit or such characteristics thereof. For example, the pad which attaches to the bottom of plate 18 could be attached by any method, such as clamps, screws, snaps, etc. Any shape of pad could be used, such as cone shaped or flat and plate 18 could be curved rather than flat. The pad could be any type, such as sandpaper, a buffing pad, a doodlebug pad, a wire brush, etc. Universal joint 16 could be eliminated or a different joining mechanism could be used. The extension pole could be used not only for sanding and working walls, but also for cleaning cars, cleaning the inside of pipes, etc. Accordingly, the disclosure of the preferred embodiment of the invention is intended to be illustrative, but not limiting, of a scope of the invention which is set forth in the following claims.

What is claimed is:

1. An apparatus for causing a working material to act on a subject surface by vibration comprising:

a plate;

means for securing said working material to a first side of said plate;

means for securing a motor to vibrate said plate; and an elongate member coupling said means for securing a motor to a second side of said plate, said means for securing a motor being pivotal with respect to said elongate member.

2. An apparatus for causing a working material to act on a subject surface by vibration comprising:

a plate;

means for securing said working material to a first side of said plate;

means for securing a motor to vibrate said plate;

an elongate member coupling said means for securing to a second side of said plate; and a handle coupled to a mid-portion of said elongate member via a shock absorbing coupler.

3. The apparatus of claim 2 wherein said shock absorbing coupler is a pair of springs coupling said handle to said elongate member.

4. The apparatus of claim 2 further comprising means for adjustably attaching said handle to different positions along said elongate member.

5. An apparatus for causing a working material to act on a subject surface by vibration comprising:

a plate;

means for securing said working material to a first side of said plate;

a hook and loop type fastener for securing a motor to vibrate said plate; and an elongate member coupling said means for securing to a second side of said plate.

6. An apparatus for causing a working material to act on a subject surface by vibration comprising:

a plate;

means for securing said working material to a first side of said plate;

means for securing a motor to vibrate said plate;

an elongate member coupling said means for securing to a second side of said plate; and a vibrating motor coupled to said means for securing a motor, said motor having a curved handle extending in an arc of at least 180°.

* * * * *